US008069840B2

(12) United States Patent
Magel

(10) Patent No.: US 8,069,840 B2
(45) Date of Patent: Dec. 6, 2011

(54) INJECTOR FOR INJECTING FUEL INTO COMBUSTION CHAMBERS OF INTERNAL COMBUSTION ENGINES

(75) Inventor: Hans-Christoph Magel, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 157 days.

(21) Appl. No.: 12/522,391

(22) PCT Filed: Dec. 6, 2007

(86) PCT No.: PCT/EP2007/063393

§ 371 (c)(1),
(2), (4) Date: Jul. 8, 2009

(87) PCT Pub. No.: WO2008/083881

PCT Pub. Date: Jul. 17, 2008

(65) Prior Publication Data

US 2010/0050990 A1 Mar. 4, 2010

(30) Foreign Application Priority Data

Jan. 9, 2007 (DE) ..... 10 2007 001 363

(51) Int. Cl.
*F02M 69/04* (2006.01)

(52) U.S. Cl. ..... 123/445; 123/467

(58) Field of Classification Search ..... 123/467, 123/468, 470, 445, 472, 490; 239/585.5, 239/87, 533.3
See application file for complete search history.

(56) References Cited

U.S. PATENT DOCUMENTS

| | | | | |
|---|---|---|---|---|
| 6,889,659 | B2 * | 5/2005 | Magel | 123/446 |
| 6,892,703 | B2 * | 5/2005 | Magel | 123/446 |
| 6,915,785 | B2 * | 7/2005 | Eisenmenger et al. | 123/446 |
| 7,083,113 | B2 * | 8/2006 | Kropp et al. | 239/92 |
| 7,188,782 | B2 * | 3/2007 | Magel | 239/96 |
| 7,273,185 | B2 * | 9/2007 | Magel | 239/88 |
| 7,418,949 | B2 * | 9/2008 | Boecking | 123/498 |
| 7,850,091 | B2 * | 12/2010 | Boecking | 239/88 |
| 2004/0154562 | A1 * | 8/2004 | Mattes et al. | 123/90.11 |
| 2007/0152080 | A1 * | 7/2007 | Boecking | 239/102.2 |
| 2008/0099583 | A1 * | 5/2008 | Magel | 239/533.3 |
| 2008/0210787 | A1 * | 9/2008 | Hanneke et al. | 239/569 |

FOREIGN PATENT DOCUMENTS

| | | | |
|---|---|---|---|
| DE | 10207227 | A1 | 9/2003 |
| DE | 102005009148 | A1 | 9/2006 |
| WO | 2005068820 | A1 | 7/2005 |
| WO | 2007012510 | A1 | 2/2007 |

* cited by examiner

*Primary Examiner* — Hai Huynh
(74) *Attorney, Agent, or Firm* — Ronald E. Greigg

(57) ABSTRACT

The invention relates to an injector for injecting fuel into combustion chambers of internal combustion engines, in particular a common rail injector. The injector has a high-pressure region and a valve element which is axially adjustable between a closed position and an open position in which the flow of fuel is enabled. According to the invention, it is provided that the valve element includes a first partial element and at least one separate second partial element, which partial elements are hydraulically coupled to one another by a coupler chamber. The coupler chamber is hydraulically connected only in one axial direction to the high-pressure region of the injector.

19 Claims, 4 Drawing Sheets

INJECTOR FOR INJECTING FUEL INTO COMBUSTION CHAMBERS OF INTERNAL COMBUSTION ENGINES

CROSS-REFERENCE TO RELATED APPLICATION

This application is a 35 USC 371 application of PCT/EP 2007/063393 filed on Dec. 6, 2007.

FIELD OF THE INVENTION

The invention relates to an injector, in particular a common rail injector.

DESCRIPTION OF THE PRIOR ART

DE 100 24 703 A1 has disclosed a common rail injector that is able to inject fuel directly into a combustion chamber of an internal combustion engine with which it is associated. To this end, a one-piece valve element is situated in a housing and has a pressure surface that acts on the whole in the opening direction of the valve element. At the opposite end of the valve element, a control surface is provided, which acts in the closing direction and delimits a control chamber. The control surface acting in the closing direction is on the whole larger than the pressure surface acting in the opening direction when the valve element is open. In the known injector it is disadvantageous that the one-piece embodiment of the valve element makes it necessary to maintain tight production tolerances and to implement different diameter segments on one component.

DE 102 07 227 A1 has disclosed a common rail injector whose valve element is composed of two parts and the two components (control rod and nozzle needle) rest against each other in a low-pressure chamber that continuously communicates with a low-pressure region of the injector. A diametrical step of the valve element is provided inside the low-pressure chamber in order to increase the hydraulic closing force. The known injector has the disadvantage of the high leakage losses that inevitably occur since the low-pressure chamber is connected to the high-pressure region of the injector by means of a guide gap in two axial directions and therefore fuel can flow into the low-pressure chamber (part of the low-pressure region of the injector) and from there, into a return line.

The subsequently published DE 10 205 034 599 has disclosed an injector in which the valve element is composed of two components and the two components (control rod and nozzle needle) are hydraulically connected to each other by means of a coupler chamber. A high fuel pressure also prevails in the coupler chamber since the coupler chamber is not connected to a low-pressure region of the injector. As a result of the hydraulic coupling, the nozzle needle follows a control movement of the control rod.

OBJECT AND SUMMARY OF THE INVENTION

The object of the invention is to propose an injector that is embodied in a simple structural fashion and is inexpensive to manufacture.

The invention is based on the idea of a multi-part embodiment of the valve element, in particular having a control rod that cooperates with a control chamber and having an axially adjacent nozzle needle that cooperates in a sealing fashion with the needle seat; the two subcomponents of the valve element are not attached to each other, but are instead coupled to each other by means of a hydraulic coupler; the coupler chamber is embodied so that it is hydraulically connected to the high-pressure region of the injector by means of only a single axial guide gap or sealing gap. The expression "high-pressure region" is understood here to mean all of the regions, i.e. chambers and conduits of the injector, in which at least approximately the rail pressure prevails at least part of the time. The coupler chamber is filled with fuel and preferably, at least approximately the rail pressure prevails inside the coupler chamber. A low-pressure stage can be completely eliminated if need be in order to minimize leakage losses. Since the coupler chamber is hydraulically connected to the high-pressure region of the injector via a guide gap not in two axial directions, but in only one, it is possible to reduce production costs because it is no longer necessary to produce two pairs of cooperating guide surfaces with tight tolerances. Another advantage of the embodiment according to the invention lies in the fact that during the activation of the valve element, the leakage losses into the coupler chamber, which is in particular at high pressure, are reduced since there is only one axial gap.

The multi-part embodiment of the valve element significantly increases the degree of freedom in the design of the injector because the respective subcomponents can be optimally adapted to their respective locations inside the injector. For example, through an appropriate selection of the dimensions and the material used, it is possible to optimally adapt the elastic properties of the valve element to the provided region in which they are used. In addition, the manufacture of the valve element as a whole is simplified to a significant degree since it is also possible to use parts with a constant diameter. This permits a simple embodiment of the injector with simpler parts, which on the one hand, facilitates production and on the other hand, enables a smaller construction. Another advantage of the hydraulic coupler is the compensation for tolerances, which simplifies production and assembly. Furthermore, a certain amount of movement damping is implemented by means of the hydraulic coupling.

One modification of the invention includes the advantageous provision that the coupler chamber is implemented by means of a sleeve. Preferably, the sleeve is guided on one of the two subcomponents that are coupled to each other by means of the coupler chamber and is spring-loaded toward the respective other subcomponent. Between the sleeve and the subcomponent on which it is guided, an axial sealing and guide gap is embodied in the axial direction, via which the coupler chamber is hydraulically connected to the pressure region of the injector. The end surface of the sleeve rests against the respective other subcomponent or more precisely stated, against a contact surface of this subcomponent, thus producing a sealing region between the sleeve and the contact surface. Because there is only a single axial gap, which thus reduces the quantity of fuel flowing into the coupler chamber during activation, it is possible to eliminate an opening of the sealing sleeve, i.e. a lifting of its end surface away from the contact surface of one of the subcomponents, thus increasing the functional reliability of the injector.

Preferably, the spring acting on the sleeve in the axial direction is situated so that it acts in the opening direction on the subcomponent in particular the control rod, situated farther away from the combustion chamber. The spring acts in opposition to a closing spring; the spring force of the closing spring is greater than the spring force of the sleeve spring so that only the differential spring force acts in the closing direction, which has a positive effect on the activation of the injector.

One modification of the invention includes the advantageous provision that the sleeve is not embodied as a separate component, but is instead integrally joined to the first or second subcomponent. This eliminates the need for both a separate component and a sealing surface at one end, which has a positive effect on the ease of assembly and on the manufacturing costs. Because the sleeve is integrally joined to the first or second subcomponent, the coupler chamber is situated inside the first and/or second subcomponent. In other words, the two subcomponents are movably guided one inside the other in an axial direction; the sole axial gap in this embodiment lies between the two subcomponents. This design makes it possible for a spring, which rests against the respective opposing end surfaces, to be situated axially between the two subcomponents. The spring force in this case must be dimensioned to be less than the spring force of a closing spring acting on one of the subcomponents.

Preferably, an axial stop is provided for the subcomponent, in particular the control rod, situated farther away from the combustion chamber so that in the rest state when the nozzle needle is resting against the needle seat, there is a gap between the two subcomponents. This reduces the stopping mass in the needle seat since only the nozzle needle and not the entire valve element is pressed against the needle seat.

BRIEF DESCRIPTION OF THE DRAWINGS

Other advantages, defining characteristics, and details of the invention ensue from the following description of preferred exemplary embodiments and from the drawings.

DESCRIPTION OF THE PREFERRED EMBODIMENTS

Figure 1:
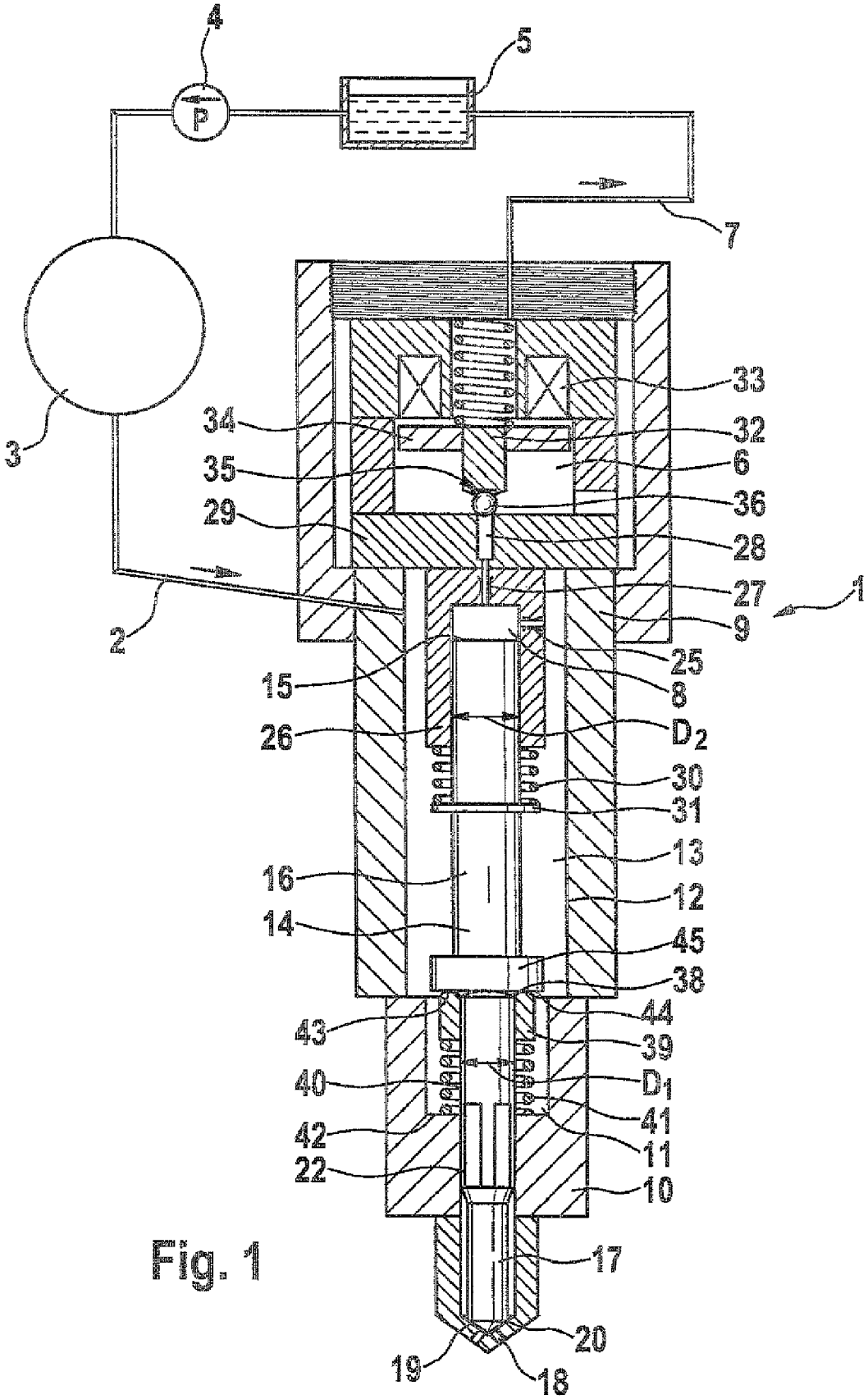
FIG. 1 shows an injector with a valve element including a control rod and a nozzle needle, which are hydraulically coupled to each other via a coupler chamber delimited by a sleeve, in which the sleeve rests in the axial direction against a contact surface of the control rod.

Components that are the same and those that serve the same functions have been labeled with the same reference numerals in the drawings.

FIG. 1 shows a common rail injector 1 for injecting fuel into combustion chambers of internal combustion engines. The injector 1 is supplied with fuel, in particular diesel or gasoline, at high pressure (approx. 1800 to 2000 bar) from a high-pressure fuel reservoir 3 (rail) via a high-pressure supply line 2. A high-pressure pump 4 embodied in the form of a radial piston pump supplies the high-pressure fuel reservoir 3 with fuel from a storage tank 5 that is at low pressure. A low-pressure region 6 of the injector is hydraulically connected to the storage tank 5 via a return line 7. Depending on the operating state, the pressure in the low-pressure region of the injector lies between approximately 0 and 10 bar. The return line 7 conveys a control quantity of fuel away from a control chamber 8 and supplies it to the high-pressure circuit via the high-pressure pump 4.

The injector 1 has an injector body 9 and a nozzle body 10; the injector body 9 and the nozzle body 10 can be clamped to each other by means of a nozzle retaining nut, not shown, that can be screw-connected to the injector body 9; the nozzle body 10 passes through the nozzle retaining nut, not shown, in the axial direction.

A stepped bore 11 is let into the inside the nozzle body 10 and continues in the axial direction into a bore 12 in the injector body 9. Inside the bores 11, 12, there is a pressure chamber 13, which belongs to the high-pressure region of the injector 1 and in which a valve element 14 is guided in a longitudinally movable fashion in the axial direction. The valve element 14 has a control rod 16, which delimits the control chamber 8 with one end surface 15, and a nozzle needle 17 axially adjacent to it in the direction toward a combustion chamber (not shown). At a needle tip 18, the nozzle needle 17 has a closing surface 19 with which it can be brought into sealed contact with a needle seat 20 embodied inside the nozzle body 10.

When the nozzle needle 17 is resting against the needle seat 20, i.e. is in a closed position, this shuts off the exit of fuel through an arrangement of injection orifices (not enumerated). But if the nozzle needle 17 is lifted away from the needle seat 20, fuel is able to flow from the pressure chamber 13 embodied in the form of an annular chamber, past the needle seat 20 to the arrangement of injection orifices, and from there, can be injected into the combustion chamber, not shown, at the high pressure (rail pressure) in an essentially constant fashion.

The nozzle needle 17 is contoured in a polygonal fashion in an axial section 22 and is guided in a circularly contoured stepped bore wall of the nozzle body 10, thus forming axial conduits (not enumerated) uniformly distributed over the circumference of the axial section, through which the fuel in the pressure chamber 13 can flow in the axial direction from the region of the mouth of the high pressure supply line 2 to the arrangement of injection orifices when the valve element 14 is open.

At the lower end of the axial section 22, there is an essentially conically formed pressure engagement surface (not enumerated) on which a compressive force acts in the opening direction.

This opening force intermittently counteracts a closing force on the end surface 15 inside the control chamber 8. The control chamber 8 is hydraulically connected to the pressure chamber 13 via an inlet throttle 25 inside a sleeve-shaped component 26. The control chamber 8 that is radially delimited by the sleeve-shaped component 26 can be connected to the low-pressure region 6 via an outlet throttle 27. In this instance, an outlet conduit 28, which contains the outlet throttle 27 and through which the fuel can intermittently flow into the low-pressure chamber 6, is thus routed through a cylindrical plate 29. A closing spring 30 prestresses the sleeve-shaped component 26 in the axial direction toward the cylindrical plate 29 that is clamped inside the injector 1. To accomplish this, the closing spring 30 is supported in the axial direction on a circumferential collar 31 of the control rod 16, as a result of which a closing force is continuously exerted on the control rod 16.

So that fuel can flow out of the control chamber 8 into the low-pressure region 6, thus reducing the compressive force acting on the end surface 15 of the control rod 16, a control valve 32 is provided, which has an electromagnetic actuator 33 that cooperates with an armature plate 34. The armature plate 34 in this case is affixed to a valve body 35, which in turn exerts force on a valve ball 36 in an axial direction. When the actuator 33 is supplied with current, the valve body 35 and therefore the valve ball 36 lifts away from a valve seat 36 embodied on the cylindrical plate 29 so that fuel can flow out of the control chamber 8 via the outlet throttle, into the low-pressure region 6, and from there, out via the return line 7. The flow cross sections of the inlet throttle 25 and the outlet throttle 27 are matched to each other so that the influx from the pressure chamber 13 into the control chamber 8 is weaker than the outflow from the control chamber 8 into the low-pressure region and therefore, when the control valve 32 is open, this yields a net outflow of fuel from the control chamber 8. The resulting pressure decrease in the control chamber 8 causes the amount of closing force to fall below that of the opening force so that the valve element 14 lifts away from the needle seat 20.

The control rod 16 and the nozzle needle 17 are hydraulically coupled to each other only by means of a hydraulic coupler chamber 38. As a result, the nozzle needle 17 follows an opening motion and closing motion of the control rod 16. The diameter D1 of the nozzle needle 17 inside a sleeve 39 that delimits the coupler chamber 38 is less than the diameter D2 of the control rod 16 guided in the sleeve-shaped component 26. The coupler chamber 38, which has no connection to the low-pressure region of the injector 1, is filled with fuel and is situated radially inside the pressure chamber 13 so that approximately the rail pressure also prevails inside the coupler chamber 38. The coupler chamber 38 is radially delimited by the sleeve 39 in which the nozzle needle 17 is guided in an axially movable fashion. A circularly contoured axial gap 40 (guide gap and sealing gap) is formed between the nozzle needle 17 and sleeve 39. This is the only guide gap via which the coupler chamber 38 is connected to the high-pressure region, in particular to the pressure chamber 13.

A helical compression spring 41, which is axially supported against an annular shoulder 42 of the stepped bore 11 inside the nozzle body 10, spring loads the sleeve 39 in the axial direction against a contact surface 43 situated on the end surface 44 of the control rod 16 oriented away from the end surface 15. The contact surface 43 here is provided on a radially enlarged shoulder 45 of the control rod 16. The spring force of the spring 41 causes the sleeve 39 to rest against the contact surface 43 in a sealed fashion. Via the sleeve 39, the spring 41 acts on the control rod 16 in the opening direction with a spring force that counteracts the spring force of the closing spring 30. The spring 41 here is embodied as weaker than the closing spring 30 so that on the whole, a slight resulting spring force continuously acts on the valve element 14 in the closing direction. Since the closing spring 30 is embodied as stronger than the spring 41, after the injection event, the greater spring force of the closing spring 30 restores the control rod 16, thus assuring a restoring of the control rod without an opening of the sleeve 39, i.e. a lifting of the sleeve 39 away from the contact surface 43. In order to optimize the closing speed of the nozzle needle, it is possible, for example, for a slight fuel throttle to be provided in the region of the axial section 22.

The exemplary embodiment according to FIG. 2 will be explained in greater detail below. The discussion will be essentially limited exclusively to the differences from the exemplary embodiment according to FIG. 1. In order to avoid repetition, for features that are shared by the two embodiments, the reader is referred to the preceding description.

Figure 2:
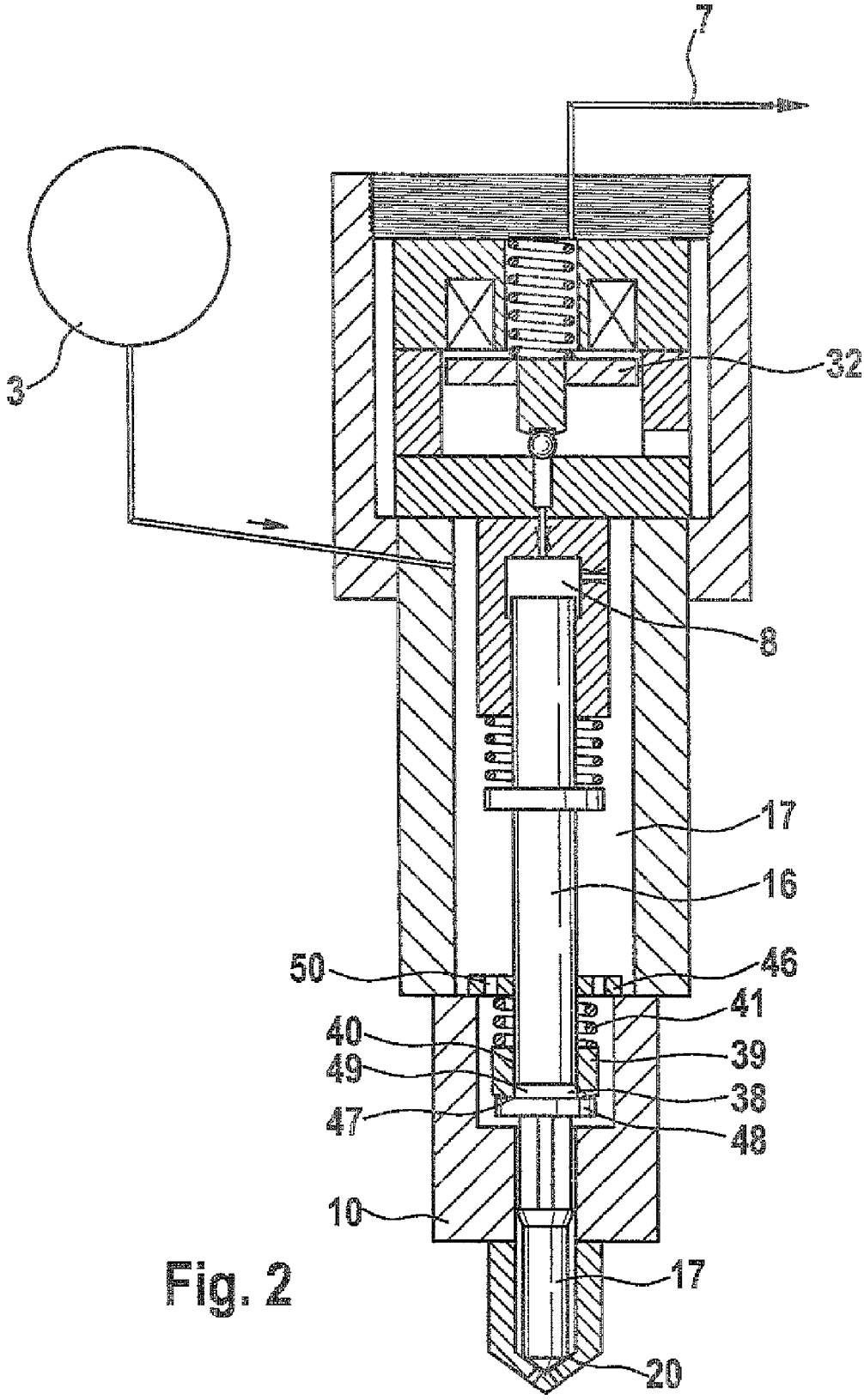
FIG. 2 shows another exemplary embodiment of an injector with a valve element having a control rod and a nozzle needle hydraulically coupled to said control rod, in which a sleeve delimiting a coupler chamber is spring-loaded in the axial direction toward a contact surface of the nozzle needle.

For the sake of clarity, the fuel circuit is only partially depicted in FIG. 2. In the exemplary embodiment shown, the coupler chamber 38 is likewise delimited by a sleeve 39. The spring 41, however, is not supported against an annular shoulder of the stepped bore 11, but rather against a radially enlarged section 46 of the control rod 16, as a result of which the sleeve 39 is spring-loaded in the axial direction toward a contact surface 47 of the nozzle needle 17 oriented away from the combustion chamber. The contact surface 47 is embodied on a radially enlarged section 48 of the nozzle needle 17.

The section 46 of the control rod 16 constitutes an axial stop for the control rod 16 against the nozzle body 10 so that in the rest state shown (in which the nozzle needle 17 is resting against the needle seat 20 and the control chamber 8 is acted on with high pressure when the control valve 32 is closed), a gap 49 is formed between the nozzle needle 17 and the control rod 16. In order to assure a flow of fuel inside the pressure chamber 13 in the axial direction to the needle seat 20, axial openings 50 are provided inside the section 46. The provision of the stop (section 46) reduces the stopping mass of the valve element in the needle seat 20 since the needle seat 20 is not struck by the entire valve element 14 (FIG. 1) at the end of the closing motion, which in turn results in a reduced wear.

The sole axial gap that hydraulically connects the coupler chamber 38 to the pressure chamber 13 is embodied between the control rod 16 and the sleeve 39 that is guided on it.

Figure 3:
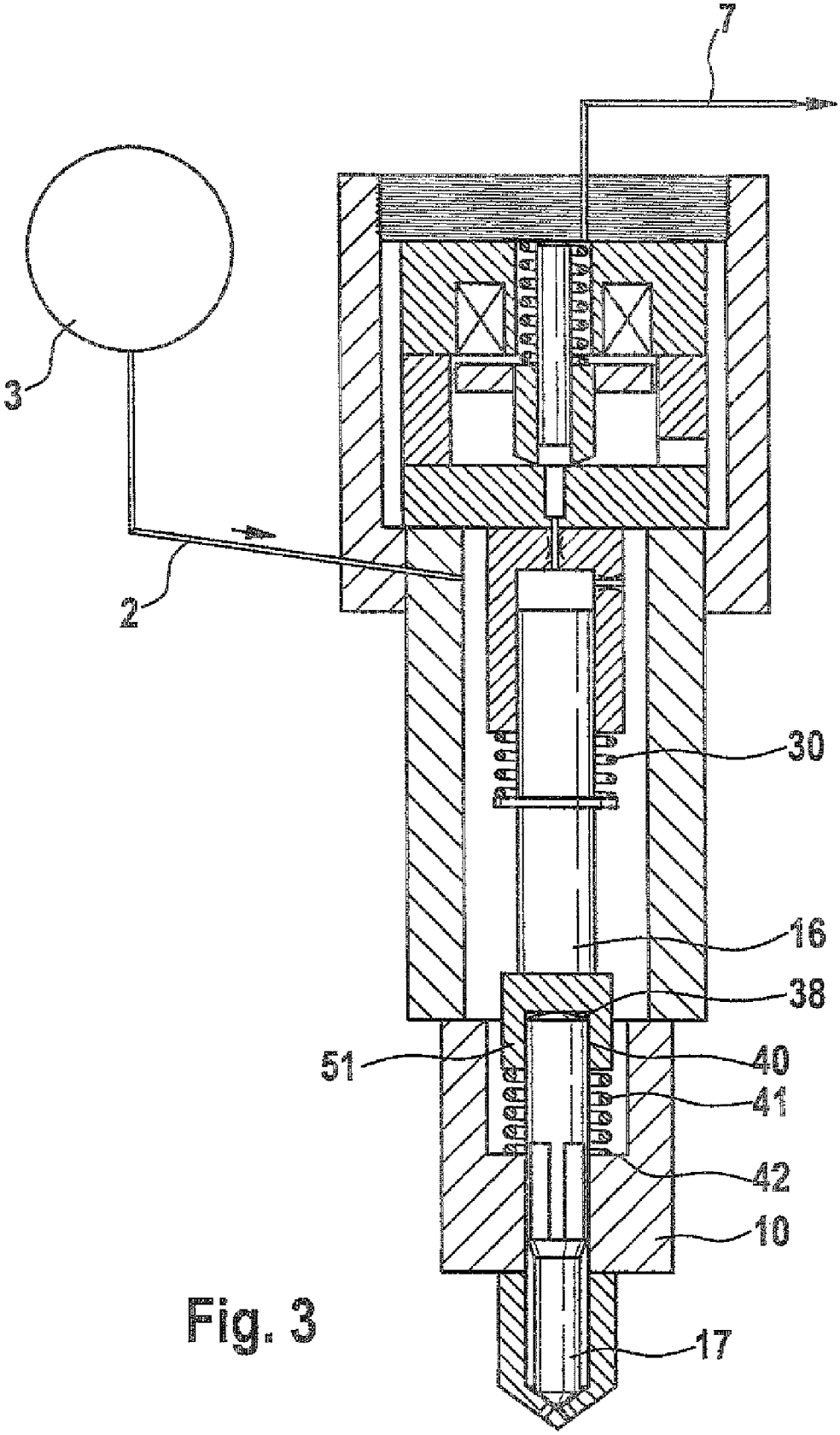
FIG. 3 shows an injector with a valve element having a control rod and a nozzle needle, in which a hydraulic coupler chamber is embodied inside the control rod and the nozzle needle is guided in the axial direction inside the control rod.

In the exemplary embodiment according to FIG. 3, no separate sleeve is provided to delimit the coupler chamber 38. The coupler chamber 38 is embodied inside the control rod 16. The nozzle needle 17 is guided in a sleeve-shaped extension 51 of the control rod 16. The spring 41 is axially supported at one end against the annular shoulder 42 of the nozzle body 10 and at the other end against the end surface of the sleeve-shaped extension 51, as a result of which the control rod 16 is spring-loaded in the opening direction. Here, too, the spring 41 is embodied as weaker than the closing spring 30 that also acts on the control rod 16. In the exemplary embodiment shown, the sole axial gap 40 connecting the coupler chamber 38 to the high-pressure region is formed between the outer surface of the nozzle needle 17 and the inner circumferential surface of the sleeve-shaped extension 51.

In order to reduce transverse forces on the nozzle needle 17, it is also conceivable, by contrast with the depiction in FIG. 3, for the control rod 16 to be axially guided inside the nozzle body 10.

Figure 4:
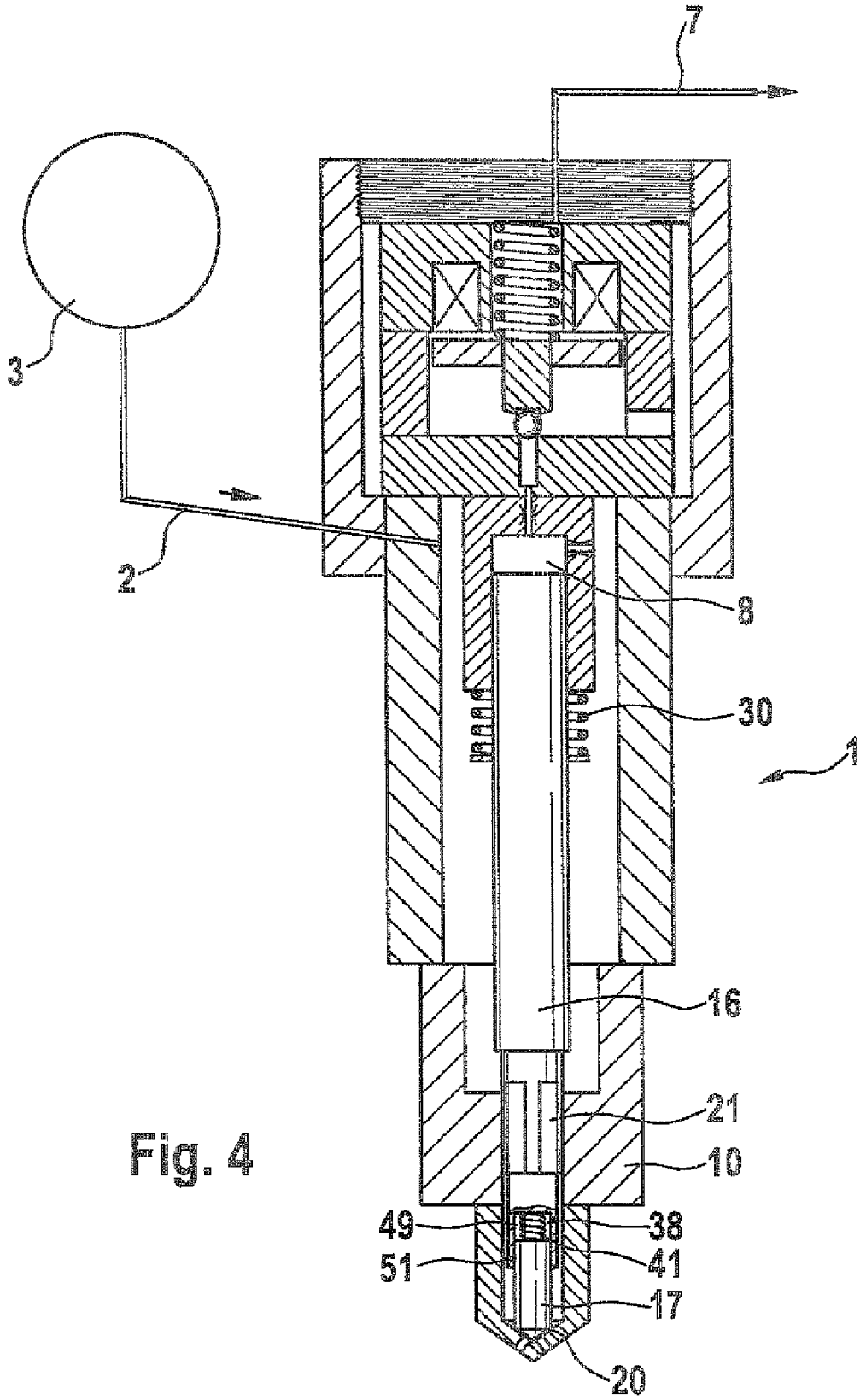
FIG. 4 shows an injector with a valve element having a control rod and a nozzle needle, in which the nozzle needle is guided inside the control rod and has a significantly smaller mass than the control rod.

In the last exemplary embodiment according to FIG. 4, the coupler chamber 38 is embodied inside a sleeve-shaped extension 51 of the control rod 16 in a fashion similar to the one in FIG. 3. In this case, the control rod 16 is axially guided with a polygonally contoured section 21 inside the nozzle needle 10 in order to avoid transverse forces on the nozzle needle 17. The nozzle needle is embodied to be significantly smaller than the control rod 16, resulting in a low mass in the needle seat. One end of the spring 41 is supported against the control rod 16 and the other end is supported against the nozzle needle 17. In the rest state shown, a gap 49 is provided between the control rod 16 and the nozzle needle 17.

The foregoing relates to the preferred exemplary embodiments of the invention, it being understood that other variants and embodiments thereof are possible within the spirit and scope of the invention, the latter being defined by the appended claims.

The invention claimed is:

1. An injector for injecting fuel into combustion chambers of internal combustion engines, in particular a common rail injector, comprising:

a high-pressure region; and a valve element (14) that is axially movable between a closed position and an open position that enables fuel flow, the valve element including a first subcomponent and at least one separate second subcomponent, which are hydraulically coupled to each other via a coupler chamber, wherein the coupler chamber is formed by a sleeve which surrounds at least a part of the first subcomponent or the second subcomponent, wherein there is a small gap between the sleeve and the subcomponent which it surrounds, and wherein the coupler chamber is hydraulically connected to the high-pressure region of the injector by the small gap, and the small gap connects to the high pressure region in only one axial direction, and wherein the first subcomponent is embodied as a control rod, which is operationally connected to a control chamber, and the second subcomponent is embodied as a nozzle needle, which cooperates in a sealing fashion with a needle seat.

2. The injector as recited in claim 1, wherein the coupler chamber is connected only to the high-pressure region of the injector.

3. The injector as recited in claim 2, wherein the coupler chamber is radially delimited by a sleeve.

4. The injector as recited in claim 3, wherein the sleeve is axially guided either on the first subcomponent or only on the second subcomponent.

5. The injector as recited in claim 4, wherein the sleeve rests either against a first contact surface, in particular an end surface, of the first subcomponent or against a second contact surface, in particular an end surface, of the second subcomponent.

6. The injector as recited in claim 5, wherein a spring is provided, which spring loads the sleeve in the axial direction toward the first or second contact surface.

7. The injector as recited in claim 6, wherein the spring is situated so that it acts on the first or second subcomponent in an opening direction, in opposition to a force of a closing spring.

8. The injector as recited in claim 3, wherein the sleeve rests either against a first contact surface, in particular an end surface, of the first subcomponent or against a second contact surface, in particular an end surface, of the second subcomponent.

9. The injector as recited in claim 8, wherein a spring is provided, which spring loads the sleeve in the axial direction toward the first or second contact surface.

10. The injector as recited in claim 9, wherein the spring is situated so that it acts on the first or second subcomponent in an opening direction, in opposition to a force of a closing spring.

11. The injector as recited in claim 1, wherein the coupler chamber is radially delimited by a sleeve.

12. The injector as recited in claim 11, wherein the sleeve is axially guided either on the first subcomponent or only on the second subcomponent.

13. The injector as recited in claim 12, wherein the sleeve rests either against a first contact surface, in particular an end surface, of the first subcomponent or against a second contact surface, in particular an end surface, of the second subcomponent.

14. The injector as recited in claim 11, wherein the sleeve rests either against a first contact surface, in particular an end surface, of the first subcomponent or against a second contact surface, in particular an end surface, of the second subcomponent.

15. The injector as recited in claim 14, wherein a spring is provided, which spring loads the sleeve in the axial direction toward the first or second contact surface.

16. The injector as recited in claim 15, wherein the spring is situated so that it acts on the first or second subcomponent in an opening direction, in opposition to a force of a closing spring.

17. The injector as recited in claim 16, wherein an axial stop is provided for the first and/or second subcomponent and, preferably in a rest state, a gap is provided between the opposing end surfaces of the subcomponents.

18. The injector as recited in claim 1, wherein the coupler chamber is situated inside the first and/or second subcomponent.

19. The injector as recited in claim 18, wherein an axial stop is provided for the first and/or second subcomponent and, preferably in a rest state, a gap is provided between the opposing end surfaces of the subcomponents.

* * * * *